US006973997B2

(12) United States Patent
Fara

(10) Patent No.: US 6,973,997 B2
(45) Date of Patent: Dec. 13, 2005

(54) POLLUTION CONTAINMENT APPARATUS FOR MAKING A PENETRATION IN A CEILING OR WALL OF A BUILDING OR OTHER STRUCTURE

(75) Inventor: Mark C. Fara, Monrovia, MD (US)

(73) Assignee: Leonard Bloom, Towson, MD (US)

( * ) Notice: Subject to any disclaimer, the term of this patent is extended or adjusted under 35 U.S.C. 154(b) by 0 days.

(21) Appl. No.: 09/823,618

(22) Filed: Mar. 30, 2001

(65) Prior Publication Data

US 2001/0045220 A1 Nov. 29, 2001

Related U.S. Application Data

(60) Provisional application No. 60/193,927, filed on Mar. 31, 2000.

(51) Int. Cl.[7] ..... E04G 1/18; A61G 11/00

(52) U.S. Cl. ..... 182/141; 312/1; 182/69.5

(58) Field of Search ..... 182/69.5, 141; 312/1, 3, 4, 114, 138.1

(56) References Cited

U.S. PATENT DOCUMENTS

| | | | | |
|---|---|---|---|---|
| 2,473,033 A | | 6/1949 | Letac | |
| 3,596,735 A | * | 8/1971 | Denier | 182/69.5 |
| 3,961,681 A | * | 6/1976 | Fisher | 182/69.5 |
| 4,067,346 A | | 1/1978 | Husted | |
| 4,108,509 A | | 8/1978 | Piet et al. | 312/1 |
| 4,335,712 A | | 6/1982 | Trexler | |
| 4,482,347 A | | 11/1984 | Borsanyi | |
| 4,505,190 A | | 3/1985 | Fink et al. | 98/115.1 |
| 4,626,291 A | | 12/1986 | Natale | 134/21 |
| 4,633,899 A | | 1/1987 | Lord | |
| 4,682,448 A | | 7/1987 | Healey | 52/63 |
| 4,765,352 A | | 8/1988 | Strieter | 134/99 |
| 4,780,927 A | * | 11/1988 | Clayton | 15/345 |
| 4,809,391 A | | 3/1989 | Soldatovic | 15/301 |
| 4,820,000 A | | 4/1989 | Jacobson | 312/1 |
| 4,911,191 A | | 3/1990 | Bain | |
| 5,062,871 A | * | 11/1991 | Lemon, III | 312/1 X |
| 5,088,511 A | * | 2/1992 | Bain | 312/1 X |
| 5,147,242 A | * | 9/1992 | Lowe, Jr. | 454/63 |
| 5,257,957 A | * | 11/1993 | Diccianni et al. | 454/57 |
| 5,295,771 A | * | 3/1994 | Wehrmann et al. | 312/1 X |
| 5,457,922 A | | 10/1995 | Fara | 52/202 |
| 5,685,112 A | | 11/1997 | Fara | 52/202 |
| 6,149,252 A | | 11/2000 | Browning | 312/1 |

FOREIGN PATENT DOCUMENTS

| | | | |
|---|---|---|---|
| DE | 2112505 | * 10/1971 | 312/1 |
| DE | 3004066 | 8/1981 | |

* cited by examiner

*Primary Examiner*—James O. Hansen
(74) *Attorney, Agent, or Firm*—Armstrong, Kratz, Quintos, Hanson & Brooks, LLP

(57) ABSTRACT

A pollution containment apparatus for removal of polluted material from a ceiling and/or a wall. The apparatus has a platform which can support a workperson and can be raised and lowered. A support on the platform holds a enclosure. The enclosure has gloves and a waste bag attached. A portion of the top of the enclosure can be opened and closed for access to the polluted portion of the ceiling and/or the wall. The entire completely assembled apparatus can be moved from one location to another.

2 Claims, 8 Drawing Sheets

POLLUTION CONTAINMENT APPARATUS FOR MAKING A PENETRATION IN A CEILING OR WALL OF A BUILDING OR OTHER STRUCTURE

CROSS REFERENCE TO RELATED APPLICATION

This application is a complete application filed pursuant to provisional patent application Ser. No. 60/193,927 filed Mar. 31, 2000, the contents of which are incorporated by reference herein in their entirety.

FIELD OF THE INVENTION

The present invention relates to a containment apparatus for preventing asbestos, lead or to other harmful materials from polluting the environment while making a penetration in a ceiling or wall of a building for subsequent service or installation purposes.

BACKGROUND OF THE INVENTION

There is a need for repairing, maintaining and updating inhabited buildings which may have lead paint, asbestos or similar toxic pollutants on the interior surfaces of walls or ceilings. The needed work may be the installation of water sprinkler systems, electrical fixtures, electrical outlets, plumbing or a myriad of other instances in which a portion of the polluted surface must be removed. The health of the building occupants is the primary concern but there is also a major consideration of the speed with which these operations can be performed to minimize inconvenience and disruption of the normal activity of the building occupants. A further major consideration is the cost to perform these services.

Lead based paint pollution is a major public hazard. The hazard of lead based paint has been recognized and documented by the United States (federal ) government. The Department of Housing and Urban Development has issued guidelines for dealing with lead-based paint hazard identification and abatement in public housing.

The federal government has also mandated lead abatement in public housing project modernization. Before undertaking such abatement projects, personnel must be properly trained as to the aspects of safety, and procedures must be instituted to minimize lead pollution affecting both the workers and the environment. When removing lead-contaminated structures, measures for controlling debris and lead dust must be instituted. The work area must be enclosed and toxic material disposed of with care. Workers must wear properly fitted respirators. Protective clothing, such as, protective overalls, disposable shoe covers, gloves, hats and goggles must be worn at all times. Care must be taken to effectively dispose of contaminated work clothing, and workers must shower to remove residual lead dust contamination.

All movable furniture, as well as draperies, should be moved out of the work area. If carpeting is to be left in place, it must be covered with two sheets of 6 mil polyethylene sheeting secured to the walls or baseboard with masking tape. Furniture left in the work area must be covered with plastic and sealed with tape. In some instances an entire area of a room is to be sealed off with tape and polyethylene sheeting running from wall to wall and floor to ceiling. All tears in plastic must be immediately repaired. Similar precautions and preparations are required for removal of asbestos and other types of contamination. Accordingly, it will be appreciated that the removal of contamination from existing building structures is no easy task; nor is it inexpensive.

Various solutions to these problems have been suggested in the prior art, but none of these intended solutions are completely satisfactory.

For example, Bain, in U.S. Pat. No. 4,911,191 disclosed an apparatus for protecting a ceiling work area from dispersal of asbestos fibers. A single support means having an adjustable height has a rectangular rack on its upper end, and the upper edge of an open mouth bag is received on the rectangular rack. The bag has gloves sealed to openings in the back to provide access to the interior of the bag. A sub-atmospheric condition is maintained within the bag. However, the bag is flexible, not rigid, and any relatively-heavy cordless power tool within the flexible bag may cause a tear or break in the bag, thereby polluting the surrounding atmosphere. Besides, the operator stands on a ladder and must continually go up and down the ladder to control a vacuum cleaner as well as pump up a fluid container. This is inconvenient and impractical. Moreover, this apparatus must be disassembled and then reassembled to make a second penetration in the ceiling, and so on during the required job, and there is no means for conveniently moving the apparatus (substantially in its assembled state) to make a series of spaced-apart penetrations in a wall or ceiling.

Additionally, German Patent DE 3004066 disclosed a box which seals to a surface being cleaned. The box is open in the side facing the surface to be cleaned. The opposite side has gloves into which a worker places his or her hands to work on the surface being cleaned. The box is held to the surface by magnetization or by reduced pressure.

To the best of the applicant's knowledge and belief, however, neither of these references has been commercialized (and certainly not to any appreciable extent) for making penetrations in a wall or ceiling.

Other prior art, of which the applicant is aware, are as follows:

| Inventor(s) | U.S. Pat. No. |
|---|---|
| Letac | 2,473,033 |
| Husted | 4,067,346 |
| Piet et al | 4,108,509 |
| Trexler | 4,335,712 |
| Jacobson | 4,482,347 |
| Fink et al | 4,505,190 |
| Natale | 4,626,291 |
| Lord | 4,633,899 |
| Healey | 4,682,448 |
| Streiter | 4,765,352 |
| Soldatovic | 4,809,391 |
| Jacobson | 4,820,000 |
| Browning | 6,149,252 |

Despite the extent of the patented prior art, the present commercial method used by environmental contractors is to build an enclosure out of 6 mil. poly film. The enclosure extends from the ceiling to the floor and encloses the personnel who are removing the contaminated portion in making a penetration or opening in the polluted portion of the ceiling and/or wall. The poly film enclosure also prevents dust and debris from entering into offices, dormitories or other living quarters. This existing method is quite inefficient because of the length of time that it takes to make such an enclosure. Moreover, the plastic or poly film is subject to tearing or cutting and would require immediate repair. To seal the enclosure against the wall, a tape or a like material has to be used; when removed from the wall, the tape leaves destructive marks on the paint or wallpaper.

If the floor is carpeted, the carpet must be covered with plastic and sealed down by tape. Sealing with tape is difficult because the tape does not always effectively seal to the carpet and furthermore, the tape could mar or ruin the carpet. If the tape itself does not stick, then a special spray glue has to be used, adding further to the inconvenience.

Finally, the poly film and the tape become contaminated and must be handled as hazardous materials and brought to a suitable landfill along with the removed material from the wall or ceiling. The disposal process is also expensive.

The prevent inventor, in U.S. Pat. Nos. 5,457,922 and 5,685,112, disclosed an apparatus and method for removing structural parts of a building (and, in particular, windows and window frames) without contaminating the adjacent areas. This apparatus comprises a containment box (or its equivalent) which has an open side adapted to fit against the window frame from within the interior of the building and to surround the window in an air tight manner, such that the window and/or window frame may be removed from outside of the building.

However, despite these teachings and the widespread extent of the prior art, no one to date (prior to the present applicant) has disclosed a practical pollution containment apparatus to fill a longstanding need for making a series of spaced-apart penetrations in a wall or ceiling, such that the penetrations may be made quickly and conveniently and without a substantial disassembly of the apparatus from one work station to another.

SUMMARY OF THE INVENTION

Accordingly, it is the primary object of the present invention to alleviate the disadvantages and deficiencies of the prior art by providing a pollution containment apparatus for making a series of spaced-apart penetrations in a wall or ceiling, such that the penetrations may be made quickly and conveniently.

It is another object of the present invention to provide such a pollution containment apparatus which can be moved from one work station or location to another without requiring any substantial disassembly of the apparatus.

It is yet another object of the present invention to provide a pollution containment apparatus which can be elevated and lowered while supporting the operator (and preferably by remote control).

It is a further object of the present invention to provide a self-contained pollution containment apparatus to minimize operator inconvenience and time on the job, thereby realizing substantial cost savings.

In accordance with the teachings of the present invention, a preferred embodiment is herein disclosed of a containment system which includes a rigid enclosure adapted to cover the portion of the building structure in which a penetration is being made. This rigid enclosure is further adapted to hold one or more tools without concern for making a tear or breach therein, and the rigid enclosure is transparent and has respective walls and further has a periphery provided with a gasket for engaging the portion of the building structure surrounding the penetration therein. A vacuum means is mounted on the rigid enclosure, externally thereof, and has an inlet on a wall of the rigid enclosure for filtering out the dust created during the penetration and for creating a negative pressure for assuring a close fit between the rigid enclosure and the portion of the building structure. At least one glove is carried by the rigid enclosure, extends internally thereof, and is adapted to receive the operator's hand. The rigid enclosure is completely self-contained for quickly and conveniently making the desired penetration.

In a preferred embodiment, a container of de-tox material (dissolved in water) is mounted on a wall of the rigid enclosure and has a hose passes through the wall to the interior of the rigid container.

Preferably, a pair of gloves receives the operator's hands, the gloves being flexible and being extended by the vacuum means; and the vacuum means comprises a filtered HEPA vacuum unit mounted on an opposite wall of the enclosure.

In the preferred embodiment, the enclosure is substantially rectangular and includes respective side walls, front and rear and walls, and a top and bottom wall, respectively. The top wall has a trap door therein, thereby providing access to the portion of the building structure in which the penetration is to be made.

Preferably, the front wall slopes downwardly and rearwardly from the top wall to the bottom wall, thereby providing improved access and convenience to the operator; and in the preferred embodiment, the front wall slopes downwardly and rearwardly by approximately 45°.

Preferably, the enclosure is mounted on a transportable support, and jack means are provided to position the enclosure against the building structure. The jack means is remotely controlled by the operator, and the transportable support is preferably a wheeled structure.

Viewed in another aspect, the present invention provides an improved method of making a penetration in a portion of a building structure and for confining the dust therein. This improved method includes the steps of providing a substantially-rigid substantially-transparent self-contained enclosure, positioning the enclosure against the portion of the building structure, and providing a vacuum within the enclosure, thereby providing a substantially air-tight seal between the enclosure and the portion of the building structure. A pair of gloves is carried by the enclosure, and the operator's hands are inserted within the gloves. At least one tool is provided within the enclosure, and the tool is grasped with at least one of the gloves for making the penetration in the portion of the building structure. The vacuum is used to remove the dust from the enclosure and to filter out the dust from the ambient air outside of the enclosure.

The improved method of the present invention further includes the steps of mounting a HEPA vacuum unit on the enclosure externally thereof, thereby providing the vacuum within the enclosure, and mounting a container of a de-tox solution on the enclosure externally thereof, the container having a hose passing through the enclosure into the interior thereof, and using the hose of de-tox solution on the interior of the enclosure after the penetration is made.

Preferably, the tool within the enclosure comprises a cordless electric tool kept within the enclosure without concern for tearing the enclosure or risking a breach therein.

DESCRIPTION OF THE PREFERRED EMBODIMENT

Figure 1:
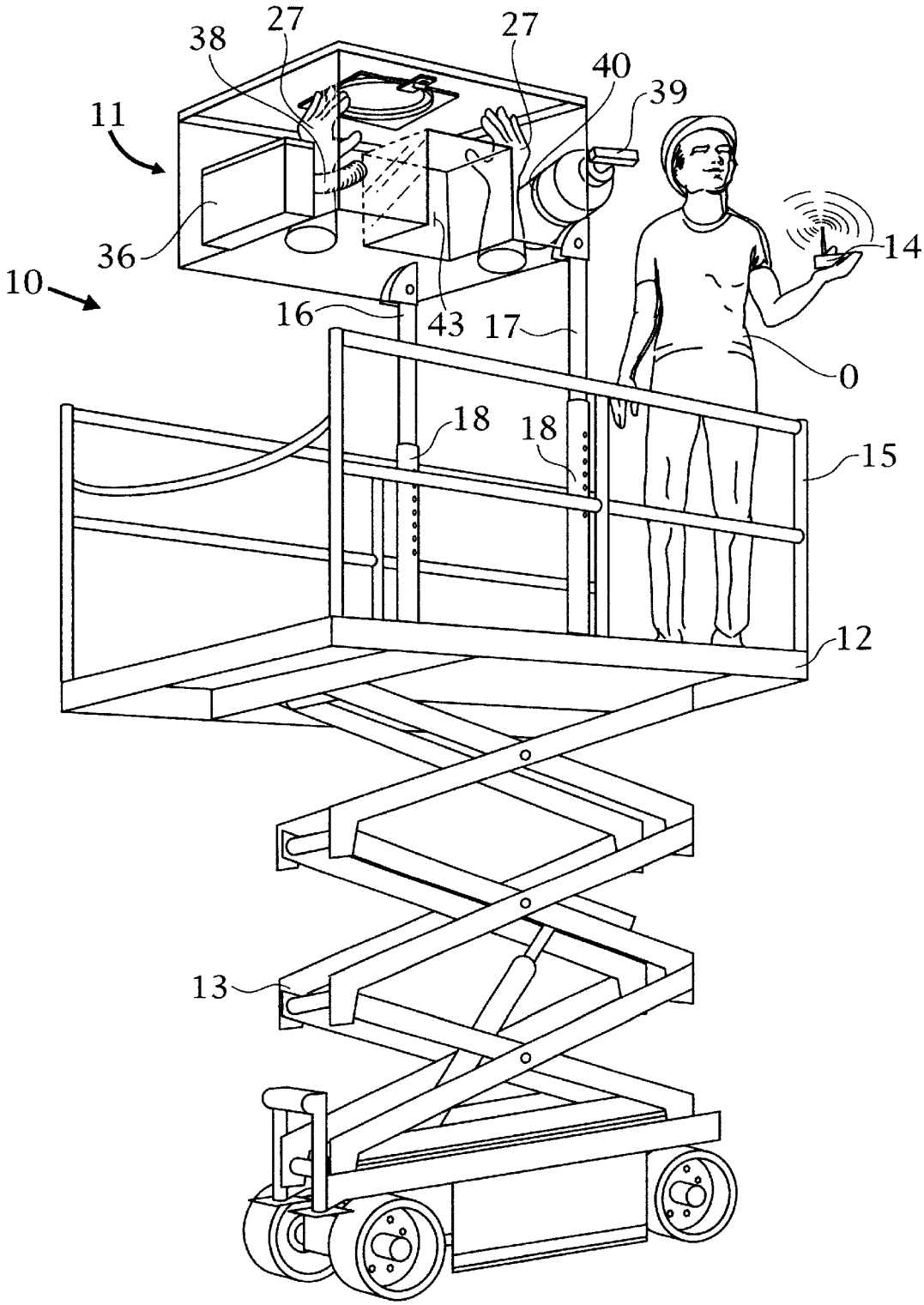
FIG. 1 is a pictorial view of a first embodiment of the apparatus of the present invention, wherein the apparatus has been elevated for making a penetration in the ceiling of a building structure.

With reference to FIG. 1, the apparatus 10 of the present invention is especially adapted for the convenient removal of a contaminated or polluted portion of a ceiling and/or wall of a building. The polluted portion may have lead paint, asbestos fibers or other hazardous material. The apparatus 10 is particularly useful in those situations where there is a need to penetrate the polluted portion, as for example, for the installation of electrical or plumbing fixtures or the subsequent installation of water sprinklers in existing buildings.

The apparatus 10 comprises a rigid transparent enclosure 11 useful in a variety of applications (as hereinafter described).

In one embodiment, adapted for making a penetration in a ceiling, an operator O stands on a platform 12, and means are provided for raising and lowering the platform 12. This means may be a power-driven scissors lift or jack 13 (or equivalent device) which can be easily and rapidly raised and lowered by power means (preferably, remotely controlled as at 14) or manually; and a frame 15 is mounted on the platform 12 and extends thereabove. The rigid transparent enclosure 11 may be adjustably mounted, vertically, on the platform 12 by means of a pair of telescoping members or posts 16 and 17, respectively, provided with a plurality of openings therethrough such that a pin 18 or suitable detent means locks the members in a desired vertical position with respect to one another.

With reference to FIGS. 2–6, the rigid transparent enclosure 11 has a front wall 19, back wall 20, side walls 21 and 22, respectively, a bottom 23, a top 24 and an interior chamber 25. As hereinafter described, an access is provided for opening and closing a portion of the top 24 of the rigid transparent enclosure 11 to provide access from within the rigid transparent enclosure 11 to the polluted portion of the ceiling or wall of the building. When the access means in the top 24 is closed, the contamination is contained within the enclosure 11 and cannot contaminate the building or area in which the work is being performed. Preferably, the rigid transparent enclosure 11 is formed from a suitable material (such as "LEXAN" polycarbonate supplied by General Electric Company) for the safety, ease and convenience of the operator O.

With further reference to FIGS. 2–6, two openings 26 are formed in the bottom 23 of the enclosure 11, and pollution-impermeable glove means are sealably connected to these openings 26. The glove means include a pair of spread-apart gloves 27 which extend into the interior chamber 25 of the rigid transparent enclosure 11 and have a length to reach completely within the rigid transparent enclosure 11.

When the operator stands on the platform 12 beneath (or adjacent to) the rigid transparent enclosure 11, the hands and arms of the operator are received in the gloves 27 to perform the work on the polluted portion of the building through an opening 28 formed in the top 24 of the rigid transparent enclosure 11. The opening 28 (in the embodiment of FIGS. 2–6) is circular and approximately six (6) inches in diameter, and the opening 28 is provided with an annular gasket 29. A hinged trap door 30 (also of "LEXAN") normally covers the opening 28 and is retained in its closed position by a first latch 31. The latch 31 may be released, and the trap door 30 may be pivoted out of the way (within the chamber 25 of the rigid transparent enclosure 11) and retained in its open position by a second latch 32. The operator O (or other worker) then has access through the opening 28 to cut a hole or other opening or penetration in the ceiling of the building structure.

The bottom 23 of the rigid transparent enclosure 11 has an opening 33, and a waste bag 34 is sealably connected to the opening 33 (FIG. 2A) and is disposed exteriorly of the rigid transparent enclosure 11. With gloves 27 within the rigid transparent enclosure 11, the operator O has access to the mouth of the waste bag 34 and the opening 33 so that large chips of the polluted portion falling into the rigid transparent enclosure 11 may be disposed within the waste bag 34.

A sealable gasket 35 is formed on the top of the rigid transparent enclosure 11, thereby forming a seal between the rigid transparent enclosure 11 and the ceiling or the wall of the building structure when the jack means 13 raises or lowers the platform 12 to the desired height. In this manner, any pollution is retained within the rigid transparent enclosure 11. Preferably, a means is provided to ensure that an adequate seal is formed between the gasket 35 and the ceiling and/or wall. This means may be a coil spring with a bar (not shown) to indicate the compression of the spring or a gauge to show the pressure between the gasket 35 and the ceiling and/or wall.

A HEPA-filtered vacuum source 36 (shown schematically in FIG. 1) is mounted on a side wall 21 of the rigid transparent enclosure 11. Air removed from the rigid transparent enclosure 11 by the vacuum source 36 is filtered to remove particulates. The interior 25 of the rigid transparent enclosure 11 is maintained at a reduced (negative) pressure, and a one-way valve 37 is mounted on the other side wall 22 of the rigid transparent enclosure 11 (opposite from the HEPA filter) to provide a means for replenishing the air within the rigid transparent enclosure 11 to maintain the negative pressure at a desired value. A flexible hose 38 passes through an opening 38A in the side wall 21 (FIG. 2) and is disposed within the rigid transparent enclosure 11 and is connected to the vacuum source 36 (with the HEPA filter)

to permit the operator O to move the flexible hose 37 through the interior 25 of the rigid transparent enclosure 11 to remove particulates therefrom.

A pressurized supply or container 39 of a de-tox water solution is mounted within a ring 40 on the side wall 22 of the rigid transparent enclosure 11, and a hose 41 with a spray nozzle 42 is disposed within the rigid transparent enclosure 11 and is connected to the de-tox supply 39 to enable the operator O to wash the interior chamber 25 of the rigid transparent enclosure 11 to remove pollution. The de-tox supply 39 may be of the manual "pump up" type (as shown) or may have a battery-operated motor driving a suitable pump (not shown).

Suitable tools (not shown) may be disposed within the rigid transparent enclosure 11 for the purpose of cutting or forming an access opening in the polluted portion of the building structure. These tools may be self-powered hand tools or may require an external source of power. For this purpose, an electrical convenience outlet (not shown) may be provided on the rigid transparent enclosure 11 so that the electrical power within the building may be available to the operator O. Alternately, cordless (battery-operated) tools may be employed.

The front wall 19 of the rigid transparent enclosure 11 has a notch 43 formed therein. The operator's head will be within the notch when the operator's hands are within the respective gloves 27.

With reference to FIGS. 7*a*–7*f*, the practical features and advantages of the apparatus 10 of the present invention (and its inherent utility) will be readily appreciated.

Figure 7A:
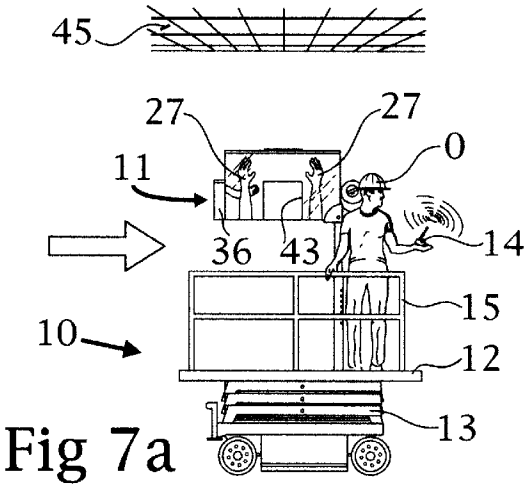
FIGS. 7*a*–7*f* are pictorial sequence views of the operation of the apparatus of FIGS. 1–6, showing its inherent utility, convenience, and ease of operation.

In FIG. 7*a*, the operator O uses the remote control 14 to move the powered scissors jack (or other jack means) 13 to a desired location more or less directly beneath the ceiling 45 within which an access opening is to be cut or formed.

Figure 7B:
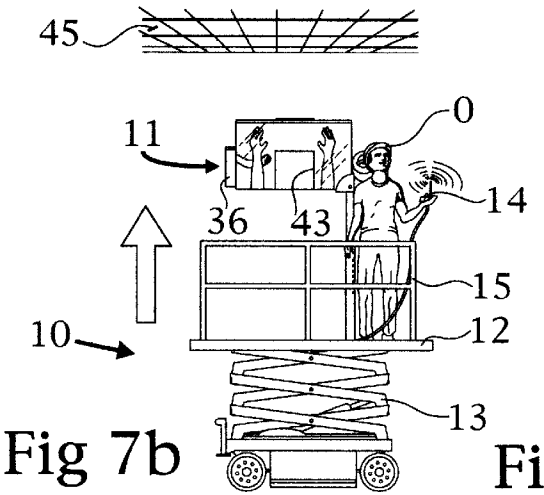
Figure 7C:
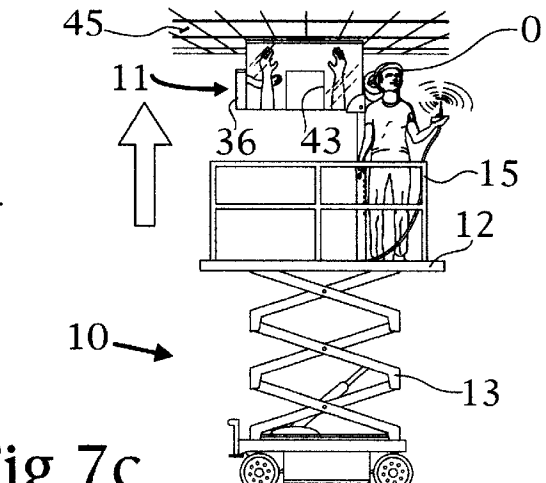

Again using the remote 14, as in FIG. 7*b*, the operator O raises the platform 12 on the scissors jack 13 to the desired height so that the gasket 35 on the top 24 of the rigid transparent enclosure 11 engages the ceiling 45 and forms a desired tight fit therebetween (as shown in FIG. 7*c*).

Figure 7D:
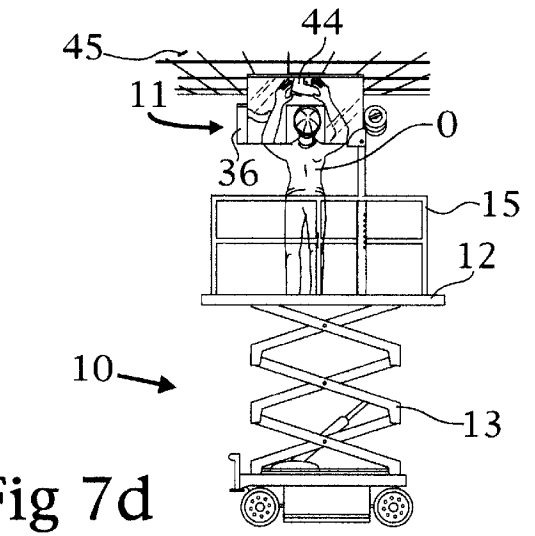
Figure 7E:
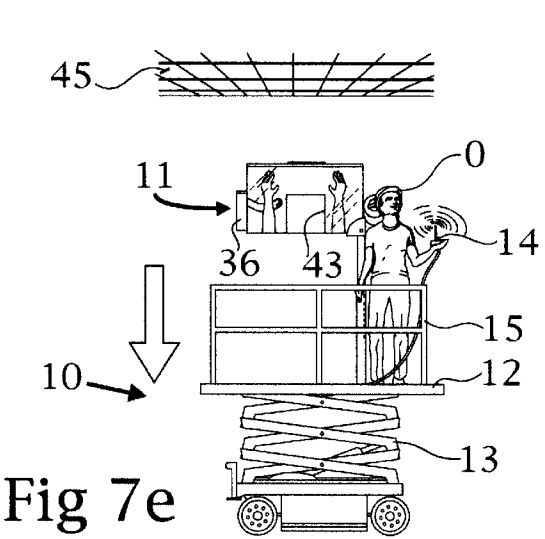
Figure 7F:
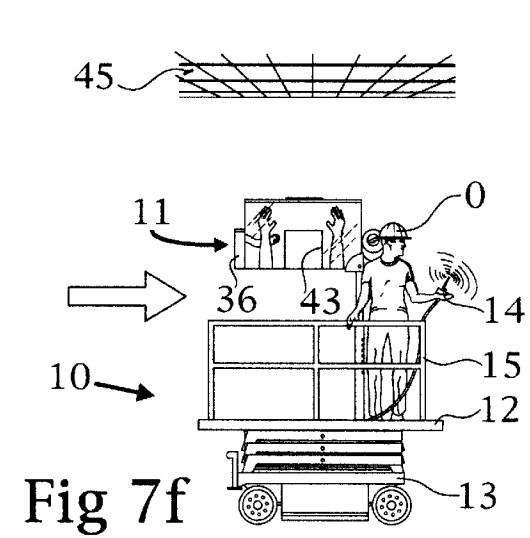

In FIG. 7*d*, the operator O inserts his (or her) hands within the gloves 27—the gloves 27 being extended when the vacuum 36 is turned on—and the operator O uses a suitable tool (such as a cordless drill 44) to cut the necessary access opening in the ceiling 45.

When the access opening in the ceiling 45 (or other wall) is complete, the operator O collects the large polluted particles in the waste bag 34, vacuums up the dust and the smaller polluted particles in the rigid transparent enclosure 11, washes down the tool (such as the cordless drill 44) and the inside of the rigid transparent enclosure 11 using the pressurized de-tox spray nozzle 42, and closes the hinged trap door 30 and secures it within the rigid transparent enclosure 11 by means of the first latch 31. The vacuum 36 may be turned off.

If desired, the operator O may remove his or her hands from the gloves 27 and twist the waste bag 34 to seal the waste contents therein. The waste bag 34 may then be removed from the opening 33 and sealed or contained to prevent leakage. A new waste bag 34 is then disposed on the opening 33.

Using the remote 14, the operator O lowers the platform 12 (FIG. 7*e*) and the rigid transparent enclosure 11 is lowered to break the seal of the gasket 35 with the ceiling 45. The operator O may then descend from the platform 12 or by use of the remote control 14, move the entire assembled electric-driven apparatus 10 to another polluted portion of the ceiling or wall. At the new location, the above steps are repeated.

This is very convenient when a series of access openings are to be made in the ceiling of a building of an older building (where asbestos or lead paint had been used extensively). The operator O doesn't have to get off the platform 12 until all of the access openings have been completed. This saves considerable time on the job. Yet there is no risk of the entire building becoming contaminated by lead-based paint particles or asbestos dust particles.

As compared to the prior art, the present invention does not require the forming of a plurality of plastic enclosures with the generation of large volumes of contaminated waste plastic. There is no need to have changes of clothing and showers for the operators. They do not need to wear respirators which are uncomfortable and reduce visibility. The time to set up the apparatus of the present invention and complete the removal fo the polluted portion is approximately one-half hour or less. The prior art requires many hours just to prepare the plastic sheeting and plastic enclosures. Furthermore, in the present invention, the operator or worker is safely raised or lowered to and from the work area. In the prior art, the worker must use a ladder with the potential problems of handling tools, waste, etc. while balanced on the ladder. The present invention is much more cost effective in addition to being safer. Additionally, the enclosure 11 is rigid, not flexible, and thus the cordless drill 44 and other tools may be kept in the enclosure 11 without risking a tear or breach of the enclosure 11 and the resultant exposure of the pollutants. On the contrary, a dust-tight seal is provided with the portion of the building structure in which the penetration is to be made. The polluted dust and other particles are confined within the rigid transparent enclosure 11, yet the operator O is isolated from the dust. Nor is there any need of evacuating the occupants of the building while the work is being done (nor any risk to the occupants remaining in the building).

The rigid transparent enclosure 11 may also be placed on a scaffold, if desired.

Being rigid, the enclosure 11 will not collapse (like a flexible bag) when the air pressure is released; and being made of LEXAN®, the enclosure 11 has very high impact strength and durability.

Being transparent, the enclosure 11 allows the operator O to have complete visibility of the entire work area.

The containment system or apparatus 10 of the present invention may be arranged to be used vertically or horizontally (and indeed at an angle) and any suitable elevating or moving supporting system may be employed for clamping against the building consonant within the teachings of the present invention.

Figure 8:
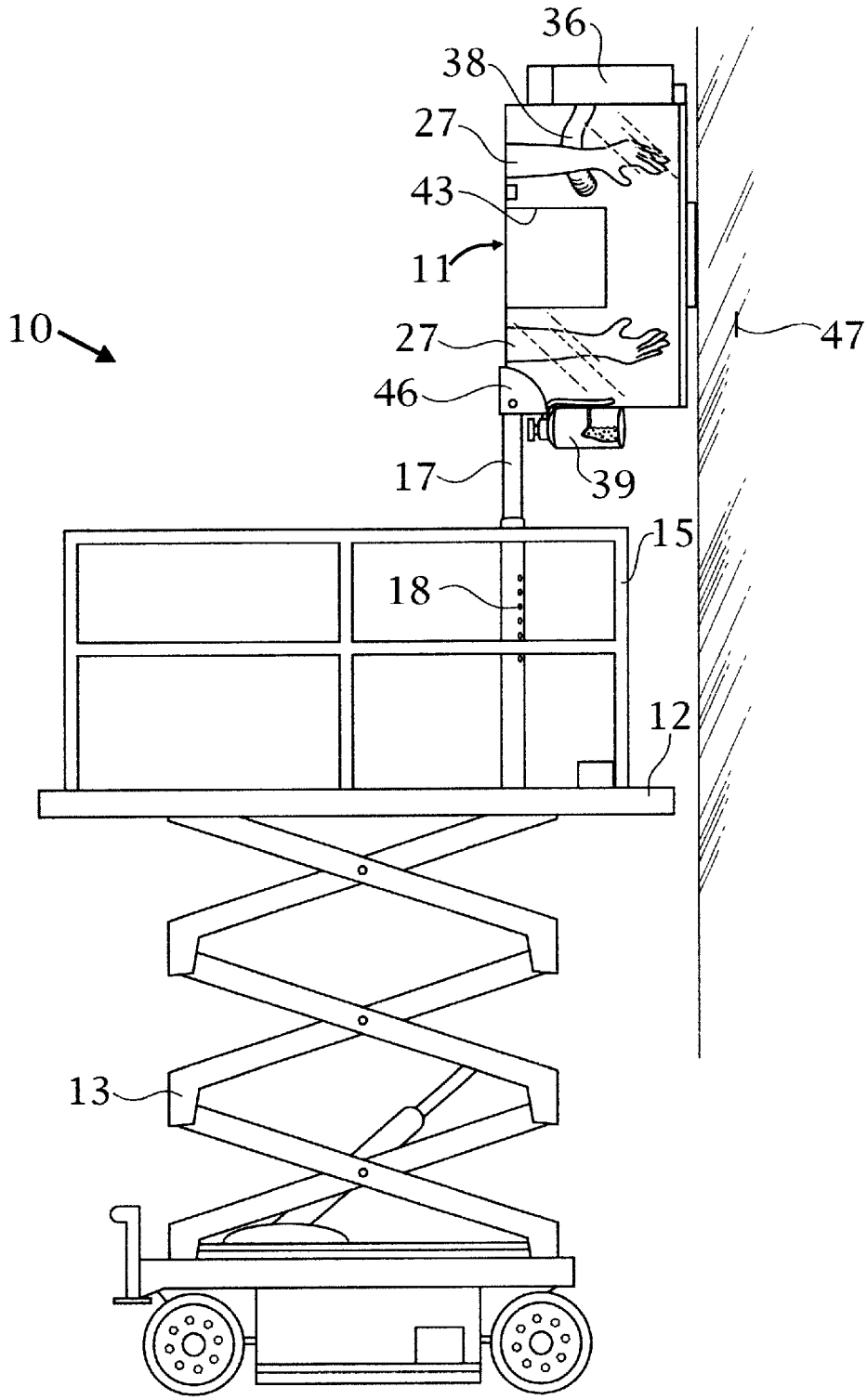
FIG. 8 shows the apparatus of FIG. 1 with its rigid transparent enclosure being pivoted approximately ninety degrees (90°) to make a penetration in a side wall of a building structure.

With reference to FIG. 8, the rigid transparent enclosure 11 may be pivoted, as at 46 to enable the apparatus 10 to be used to make a pollution-free access opening in a side wall 47 of the building structure.

Figure 9:
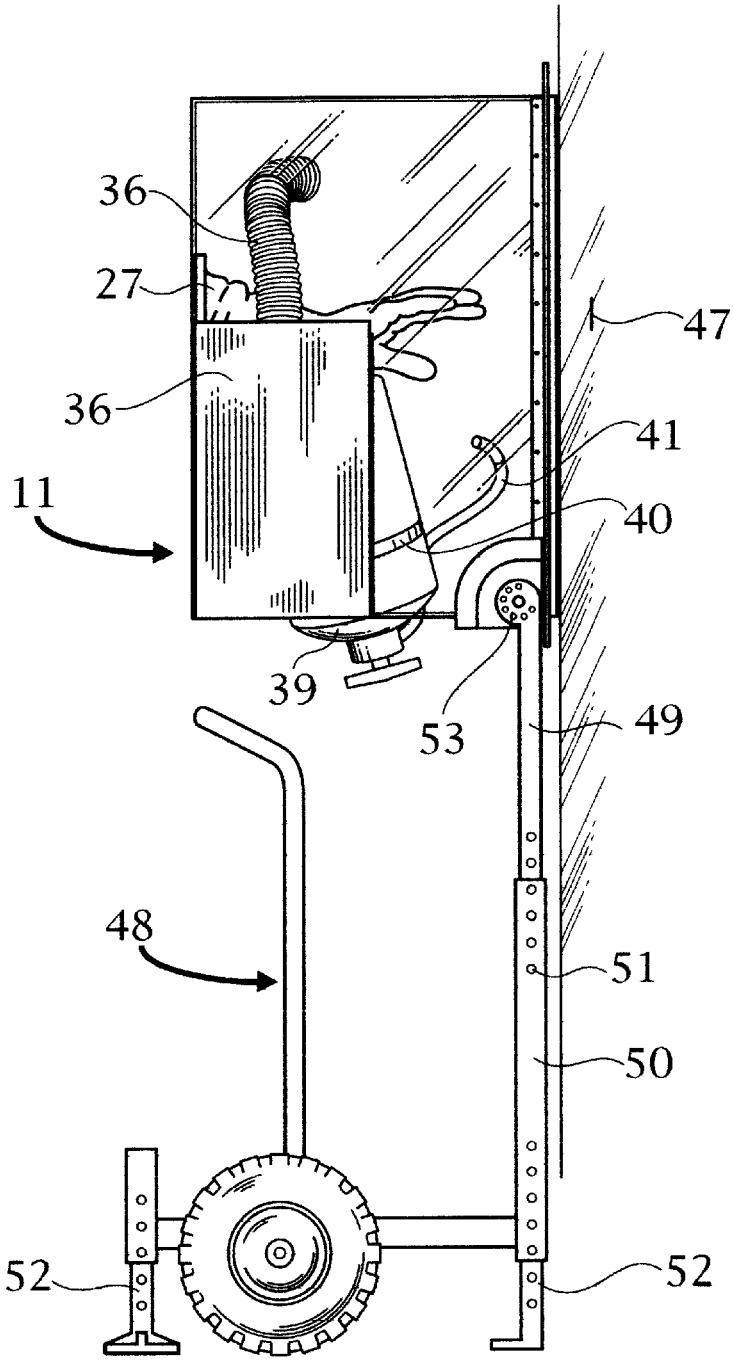
FIG. 9 corresponds to FIG. 8, but shows the rigid transparent enclosure mounted on a hand truck.

With reference to FIG. 9, the rigid transparent enclosure 11 may be mounted on a hand truck 48 for making a penetration in the side wall 47. The rigid transparent enclosure 11 may be mounted on telescoping members 49 and 50, respectively, connected by one or more pins 51. The hand truck 48 may also be provided with adjustable feet 52, if desired, and the combination provides a convenient vertical height adjustment. A pivot 53 is also provided.

Figure 11:
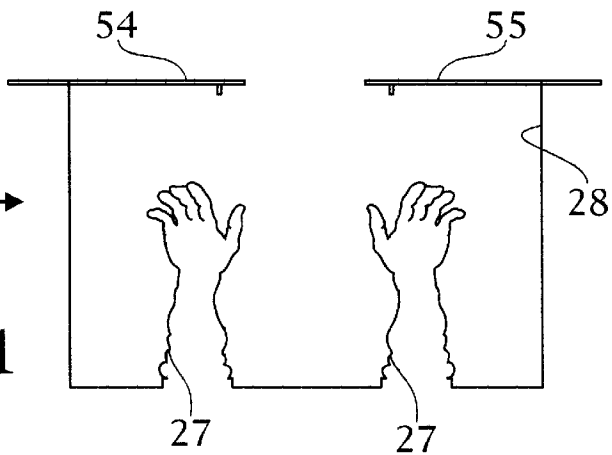
FIG. 11 is a schematic side elevational view, corresponding to FIG. 10, but showing the sliding member open in the top.
Figure 10:
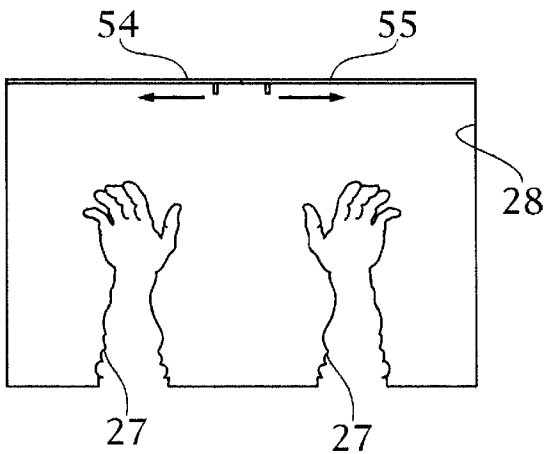
FIG. 10 is a schematic side elevational view of another embodiment of the rigid transparent enclosure (of FIGS. 1–9) but showing sliding members closed in the top portion of the enclosure (in lieu of a pivoted trap door).

In lieu of the hinged trap door of 30 of FIGS. 2–6, the rigid transparent enclosure 11 may be provided with sliding doors 54 and 55, respectively, shown schematically in FIGS. 10 and 11

Figure 13:
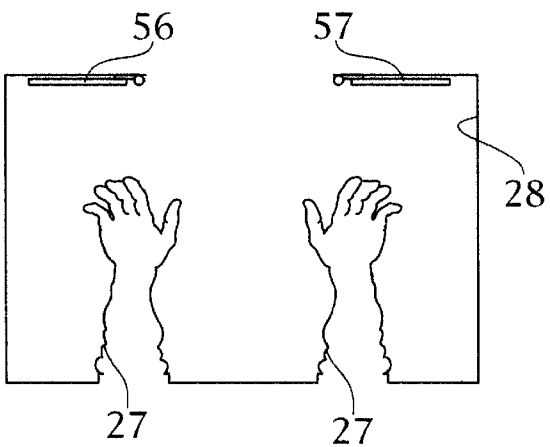
FIG. 13 is a further schematic side elevational view, corresponding to FIG. 12, and showing the folding doors opened in the top of the enclosure.
Figure 12:
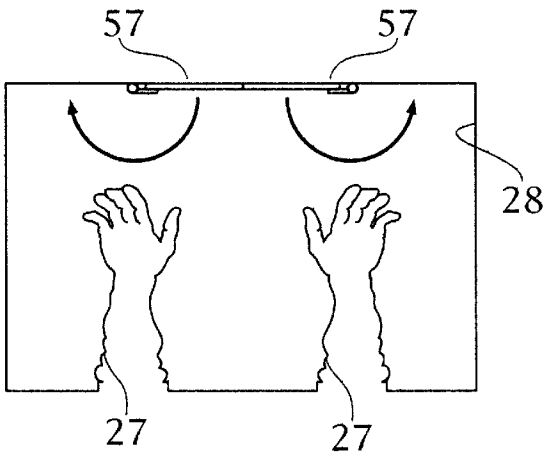
FIG. 12 is a further schematic side elevational view, showing hinged doors closed in the top of the enclosure.

Hinged doors 56 and 57, as shown schemtically in FIGS. 12 and 13.

Figure 2:
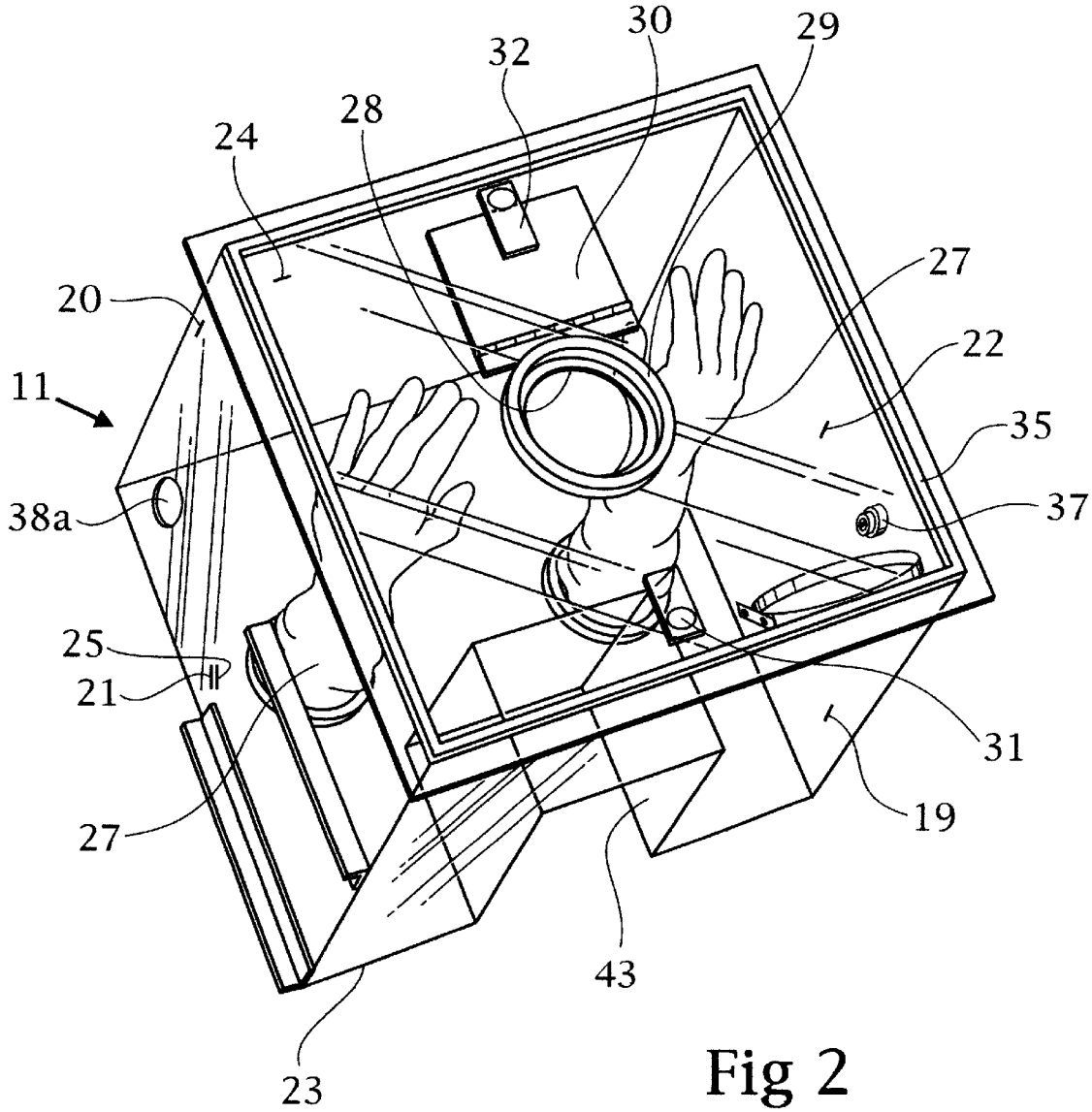
FIG. 2 is a pictorial view of the rigid transparent enclosure of the apparatus of FIG. 1, certain external equipment being removed for ease of illustration.
Figure 2A:
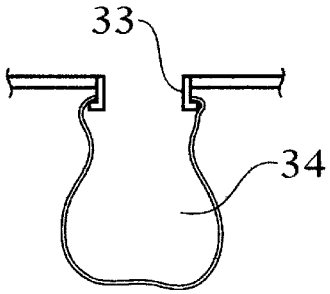
FIG. 2A illustrates a waste bag attached to an opening in the bottom of the rigid transparent enclosure.
Figure 4:
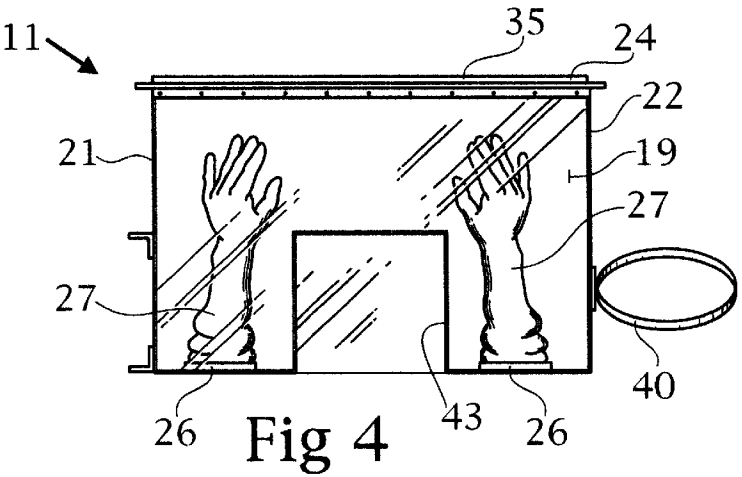
FIG. 4 is a front elevational view thereof.
Figure 6:
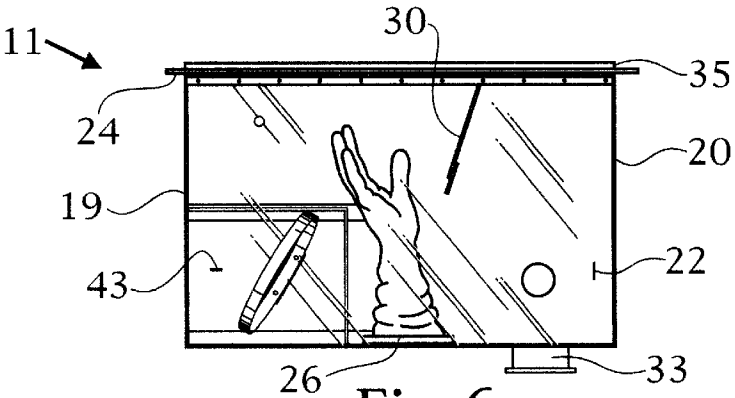
FIG. 6 is a right side elevational view thereof.
Figure 3:
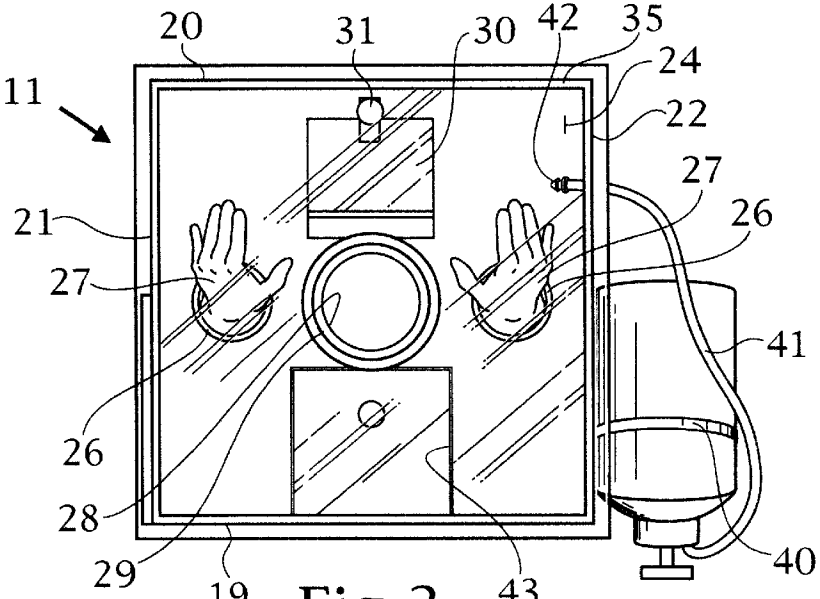
FIG. 3 is a top plan view of the rigid transparent enclosure of FIGS. 1 and 2.
Figure 5:
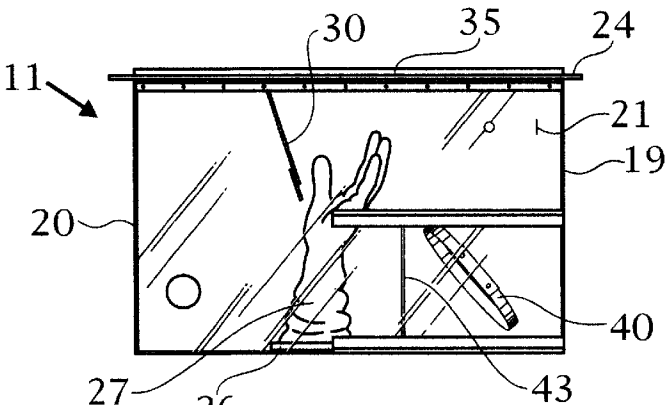
FIG. 5 is a left side elevational view thereof.
Figure 14:
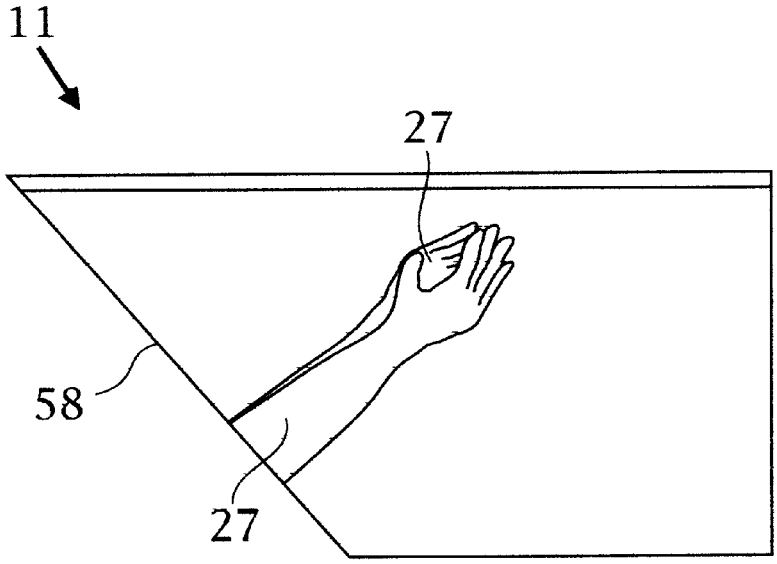
FIG. 14 is a schematic view of another embodiment of the rigid transparent enclosure in the present invention.

Moreover, in lieu of the notch 43 shown in FIGS. 2 and 6, the rigid transparent enclosure 11 may be provided with a sloping front wall 19' shown schematically in FIG. 14. This arrangement may be more convenient for certain operators to use.

Obviously, many modifications may be made without departing form the basic spirit of the present invention. Accordingly, it will be appreciated by those skilled in the art that within the scope of the appended claims, the invention may be practiced other than has been specifically described herein.

What is claimed is:

1. A containment system for making a desired penetration in a portion of a building structure, wherein dust is generated in making the penetration, and for confining the dust therein, comprising a rigid transparent enclosure adapted to cover the portion of the building structure while a penetration is made therein, the rigid transparent enclosure being substantially rectangular and comprising respective side walls, front and rear end walls, and a top and bottom wall, respectively, whereby one or more tools may be housed in the rigid transparent enclosure without concern for making a tear or breach therein, at least one of the walls of the rigid transparent enclosure having a tray door therein, thereby providing access to the portion of the building structure in which a penetration is to be made, the at least one wall further having a periphery provided with a gasket for engaging the portion of the building structure surrounding the penetration therein, a HEPA vacuum means carried by one of the side walls of the rigid transparent enclosure externally thereof and having an inlet on the one side wall of the rigid transparent enclosure for filtering out the dust created during the penetration and for assuring a close fit between the gasket on the periphery of the one side wall of the enclosure and the portion of the building structure in which the penetration is to be made, a pair of gloves carried by the front wall of the enclosure, extending internally of the enclosure, and a container of de-tox material carried by the other side wall of the rigid transparent enclosure and having a hose passing through the other side wall to the interior of the rigid transparent enclosure, and wherein the enclosure is mounted on a transportable support.

2. A containment system for making a desired penetration in a portion of a building structure, wherein dust is generated in making the penetration, and for confining the dust therein, comprising a rigid transparent enclosure adapted to cover the portion of the building structure while a penetration is made therein, the rigid transparent enclosure being substantially rectangular and comprising respective side walls, front and rear end walls, and a top and bottom wall, respectively, whereby one or more tools may be housed in the rigid transparent enclosure without concern for making a tear or breach therein, at least one of the walls of the rigid transparent enclosure having a trap door therein, thereby providing access to the portion of the building structure in which a penetration is to be made, the at least one wall further having a periphery providing with a gasket for engaging the portion of the building structure surrounding the penetration therein, a HEPA vacuum means carried by one of the side walls of the rigid transparent enclosure externally thereof and having an inlet on the one side wall of the rigid transparent enclosure for filtering out the dust created during the penetration and for assuring a close fit between the gasket on the periphery of the one side wall of the enclosure and the portion of the building structure in which the penetration is to be made, a pair of gloves carried by the front wall of the enclosure, extending internally of the enclosure, and a container of de-tox material carried by the other side wall of the rigid transparent enclosure and having a hose passing through the other side wall to the interior of the rigid transparent enclosure, wherein the front wall slopes downwardly and rearwardly from the too wall to the bottom wall, thereby providing improved access and convenience to the operator, and wherein jack means are provided to position the enclosure against the building structure.

* * * * *